United States Patent [19]

Hou

[11] Patent Number: 4,729,679

[45] Date of Patent: Mar. 8, 1988

[54] STRUCTURE OF THE KEYBOARD BUTTON BASIC PAD

[75] Inventor: Johnny Hou, Taipei City, Taiwan

[73] Assignee: Silitek Corporation, Taipei, Taiwan

[21] Appl. No.: 855,115

[22] Filed: Apr. 23, 1986

[30] Foreign Application Priority Data

Dec. 17, 1985 [TW] Taiwan ..... 74210700

[51] Int. Cl.[4] ..... B41J 5/12

[52] U.S. Cl. ..... 400/490; 264/273; 400/495

[58] Field of Search ..... 400/490, 495; 264/273, 264/249

[56] References Cited

U.S. PATENT DOCUMENTS

| | | | |
|---|---|---|---|
| 3,489,342 | 1/1970 | Anderson | 400/490 X |
| 4,311,656 | 1/1982 | Spriggs | 264/273 X |
| 4,336,948 | 6/1982 | Couture | 264/273 X |
| 4,342,799 | 8/1982 | Schwochert | 264/273 X |
| 4,449,839 | 5/1984 | Bleuer | 400/490 X |
| 4,500,218 | 2/1985 | Nishikawa | 400/490 |

OTHER PUBLICATIONS

"Dummy Key Implementation", by Barker et al., IBM Technical Disclosure Bulletin, vol. 15, No. 6, Nov. 1972, pp. 1930–1931.

*Primary Examiner*—Edgar S. Burr
*Assistant Examiner*—Moshe I. Cohen
*Attorney, Agent, or Firm*—Poms, Smith, Lande & Rose

[57] ABSTRACT

A keyboard pad for use in conjunction with computers is made of a rigid plastic material while the keys of the basic pad are made of rubber so that the assembly of the keys into the pad may be automatically facilitated, reducing or limiting the need for manual construction thereby reducing the cost of materials and constructing the keyboard assembly.

5 Claims, 9 Drawing Figures

STRUCTURE OF THE KEYBOARD BUTTON BASIC PAD

FIELD AND BACKGROUND OF THE INVENTION

1. Field of the Invention

This invention relates to keyboards and more particularly keyboards for use in conjunction with computers and related hardware.

2. Background of the Invention

Heretofore computer keyboards have used numerous varieties of rubber material for control contacts or insulating contacts for the purpose of replacing a spring within the keyboard buttons. It is generally known in the art that once a computer keyboard button is pressed, each button must exhibit an ability to immediately cover and restore its initial home position. One method of keyboard key recovery was to place a button on the helical spring which biases the button upward and normally off. When such a spring loaded button is depressed and then released, the spring causes the button to be restored to its original non-contact position. Using elastic rubber is currently practiced in place of a spring. A keyboard made from rubber is significantly resilient to restore its original form without the need for insertion of a spring within the button. Existing keyboards have used elastic rubber as the material of preferred choice to form keyboards which have the capacity of allowiing keyboard buttons to be restored to their original position. An example of current keyboards formed from rubber material is shown in FIGS. 1, 1—1, and 1-2. Such keyboards made from rubber are generally too soft, and the basic pad is not easily aligned during installation so that correspondence of the holes 11 with pins on the computer for securing the keyboard to its housing is not easily achieved. Generally, in order to allow a keyboard made from rubber material to properly be coincided and placed on a frame in the manufacturing process, manual assistance is necessary to assemble the keyboard and use of a machine to accomplish the assembly of a conventional keyboard as shown in FIG. 1 is not ideally achievable. Additionally important is the fact that the shrinkage rate of rubber is high, especially when rubber is used as a single entire piece to make up the keyboard. More sophisticated production techniques are required to achieve the precision necessary for a unitary one piece rubber keyboard to the placed within the framework of an entire keyboard assembly. The aforesaid assembly problem being complex is not easily adaptable for automatic assembly thereby driving the cost of manufacture and sale high. Heretofore, therefore, traditional computer keyboards which use rubber material for the board do not allow an economical sale that may be achieved with a lower production cost. The high cost of production for conventional keyboards is a distinct disadvantage of prior keyboard designs.

SUMMARY OF THE INVENTION

In contrast to the structure and materials used to make traditional keyboards, the applicant has provided a lower prduction cost keyboard which comprises a resilient non-elastic plastic material, a molded basic pad, and a rubber material molding for the keys of the keyboard. The basic pad is made from a hard, low shrinkage, non-resilient material, while each key button is made from a resilient material which allows the key button to restore its original shape after user activation of the button. The key buttons are placed through button holes defined in the pad and attached thereto. Each button position is defined by a larger hole in the plastic material basic pad, each large button hole being surrounded by eight to twelve small holes. The diameter of the lower part of the hole is larger than the top part of the hole; and, the small holes are positioned across the basic pad top of the hole so that a rubberized button may be riveted into the hole having the elastic capability of restoration without the need for springs to bias the return of the keyboard buttons. The particular design of the invention of this disclosure allows assembly of the keyboard by a machine allowing the automation of the production of the keyboard.

BRIEF DESCRIPTION OF THE DRAWINGS

FIG. 1 is a perspective view of the conventional prior disclosure.

FIG. 1—1 is a fragmented large view of a button section of FIG. 1.

FIG. 1-2 is a fragment sectional view of FIG. 1—1 taken through the button shown in FIG. 1-2.

FIG. 2 is a perspective view of the view of the present invention of this disclosure, showing the invention during assembly.

FIG. 2-1 is a fragmented sectional view of FIG. 2.

FIG. 2—2 is a sectional view of across line A—A of FIG. 2 showing the construction of the keyboard at the keyhole position.

FIG. 3 is a perspective view of the present invention showing a fully installed and manufactured keyboard.

FIG. 3-1 is a fragmented enlarged view of FIG. 3.

FIG. 3-2 is a fragmented sectional view of FIG. 3.

DETAILED DESCRIPTION OF THE PREFERRED EMBODIMENT

Figures 1, 2:
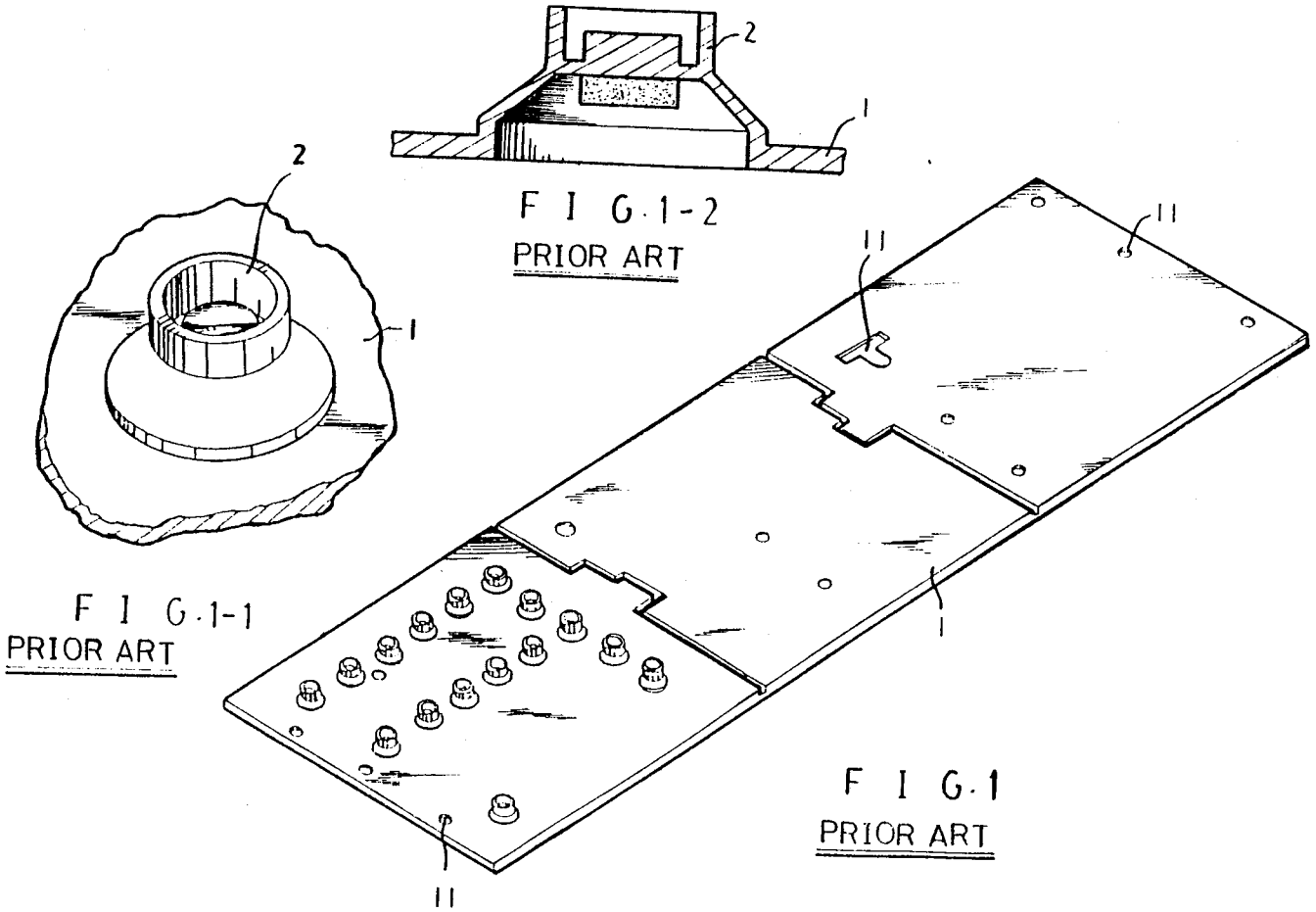
FIG. 1-2 PRIOR ART
FIG. 1-1 PRIOR ART
FIG. 1 PRIOR ART
Figures 1, 2:
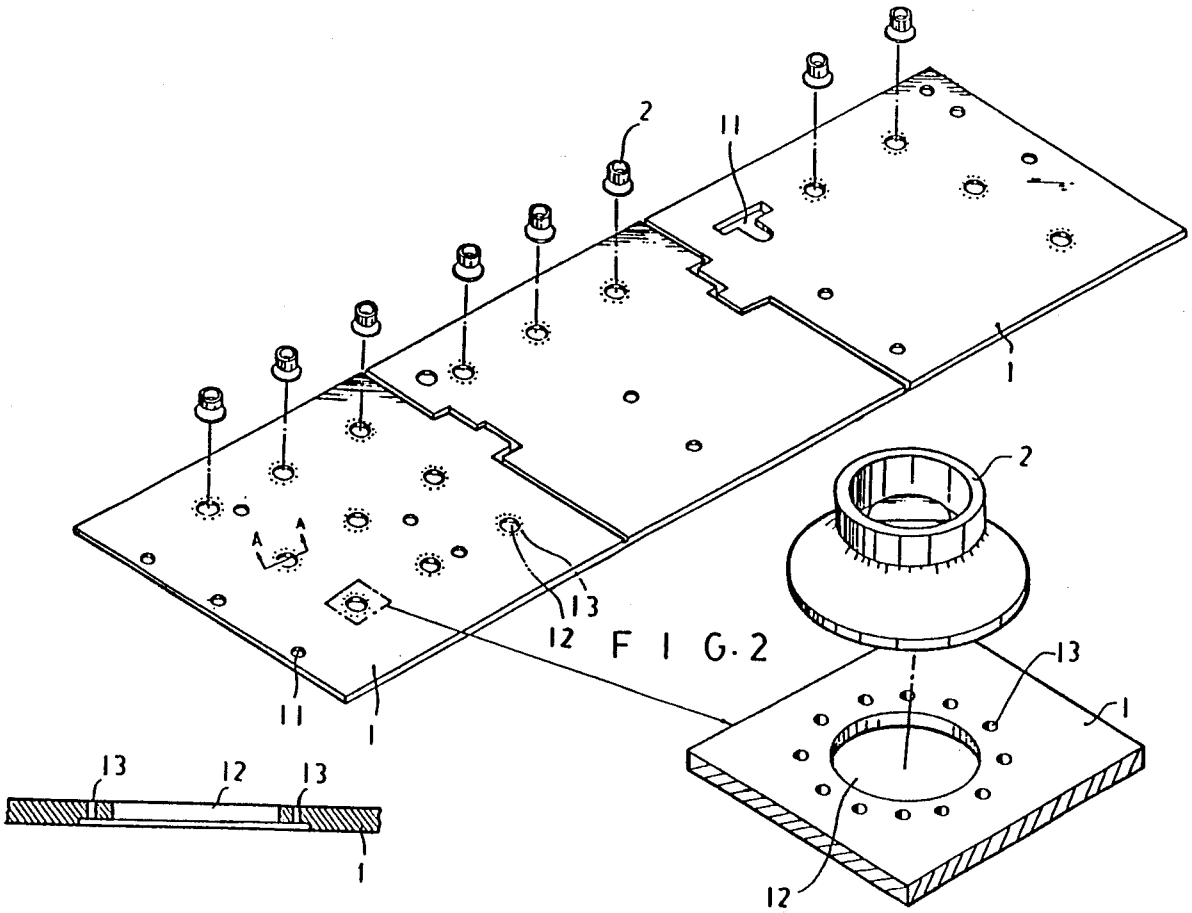
Figures 1, 2, 3:
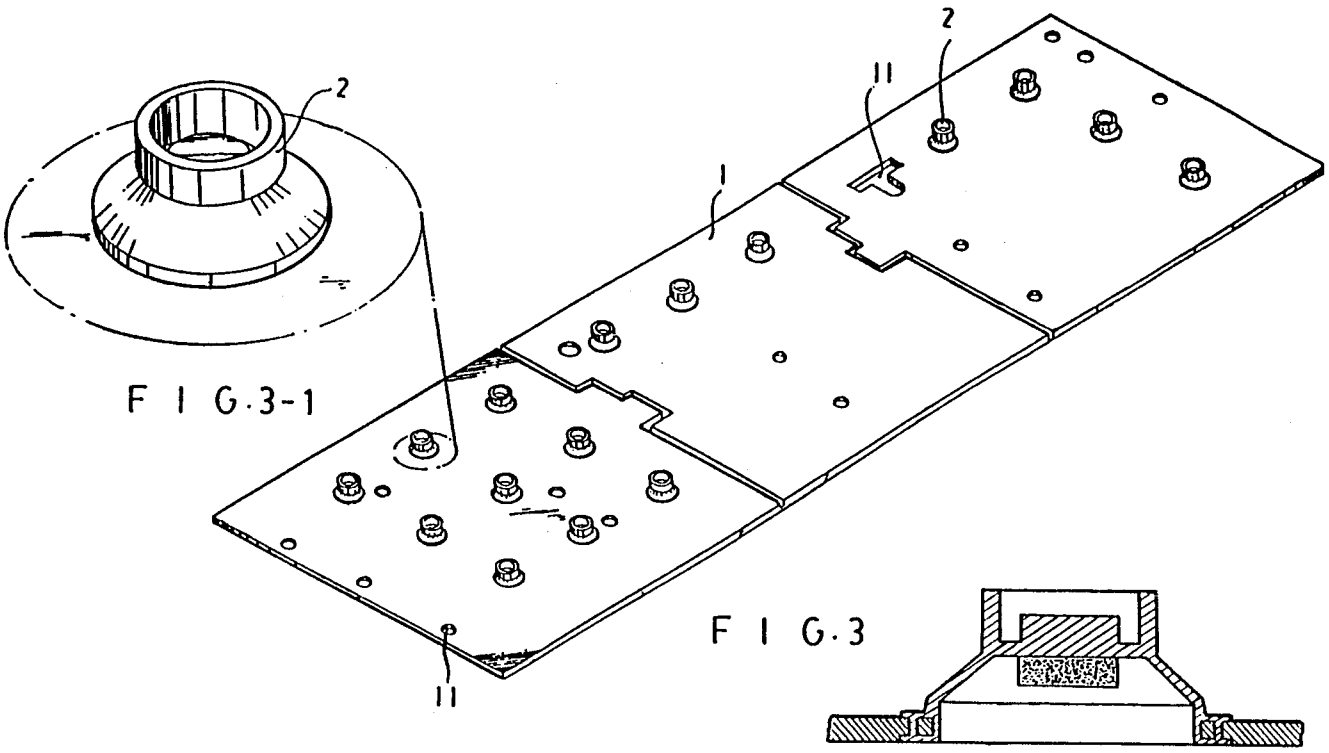

With reference to FIG. 2, in order to stabilize the basic pad 1, the various corresponding holes 11 must be aligned with co-incident pegs or other securement posts not shown in part of the frame or housing of the keyboard. It is therefore important that the size of the basic pad 1 must be precise. In order that the basic pad 1 be easily located within the frame of the keyboard, it is therefore advisable to use a hard material for the basic pad 1 such as a resilient plastic material which must provide excellent insulating properties. The material comprising the basic pad 1 must also show low shrinkage rate, low cost, hard quality, and temperature durability as well as excellent insulating qualities. All of these requirements may be fulfilled by a plastic material product for use to form the basic pad 1. During molding, the larger button hole 12 must be provided at the location of each keyboard button 2. Surrounding the hole 12 about its circumference are 8 to 12 small holes 13 located and disbursed around the subject principal hole 12. The diameter of the lower part of hole 12 is larger than the point where the small holes 13 are disbursed about hole 12. Respecting the fact that the keyboard button 2 must have recovery or resilient properties, a plastic material suitable for recovery of the button may be used. The basic pad 1 during manufacturing may be located inside the mold for molding the keyboard button 2 during the molding process. In this manner, the plastic material mold used to form the keyboard button 2 will flow inside each small hole forming a riveting state as shown in FIG. 3 while securing the keyboard button 2 onto the basic pad 1. For further ease of understanding, the advantages of the present invention are listed as follows:

1. The price of the plastic material used to construct the keyboard is far lower than the currently used rubber material and thereby allows lowering production costs.

2. The shrinkage rate of the plastic material used to form the keyboard is much lower than the rubber material, since generally the shrinkage rate of the plastic material selected is 0.3%, while the shrinkage rate of the rubber material is in the range of 3 to 4.2%. A mold design for a plastic keyboard is easy to manufacture and such use of a mold facilitates production and enhances the precision of the keyboard.

3. Plastic material used to manufacture the keyboard is harder than rubber material yet it provides a precision size capable to being assembled by machine; thereby, allowing the automation of the production which, in turn, increases production capacity.

Accordingly, the present invention solves the problems presented by the traditional solutions to the manufacture of a keyboard. The present invention allows a higher production capability in value because it is more suited to automation than the structure currently taught. By manufacturing the present invention using two phases of molding, problems traditionally faced by one stage molding are avoided and the design achieved is significantly more precise.

I claim:

1. A keyboard assembly having at least one key button comprising:

a basic pad made from a non-resilient material having at least one button hole;

at least one key button made from a resilient material affixed within the button hole;

said button holes having a plurality of small passageways located at the periphery of each of the button holes; and, said key buttons being riveted to each button hole through said small passageways located around each button hole.

2. The keyboard assembly of claim 1, wherein the diameter of each button hole at its bottom exceeds the diameter of the top of the button hole, the small passageways forming small holes between the top surface of said pad and the button hole within the lower diameter of the button hole.

3. A keyboard assembly having at least one key button, the keyboard assembly comprising:

a basic pad made of a hard material having low shrinkage characteristics;

said basic pad having at least one button hole for the insertion of key buttons, each hole having a plurality of small passageways located at the periphery of the button hole;

at least one key button, each button made from a resilient material, each button being riveted to each button hole through said small passageways located around each button hole.

4. The keyboard assembly of claim 3, wherein the diameter of each button hole at its bottom exceeds the diameter of the top of the hole, the small holes forming a passageway between the top surface of said pad and the button hole within the lower diameter of the button hole.

5. A keyboard assembly having at least one non-resilient material basic pad having at least one button hole and at least one resilient material key button affixed within said button hole, wherein the improvement comprises:

a plurality of small passageways located adjacent the periphery of the button hole; and, said key buttons being riveted to each button hole through said small passageways located about each button hole.

* * * * *